US005316215A

United States Patent [19]

Mitchell

[11] Patent Number: 5,316,215

[45] Date of Patent: May 31, 1994

[54] LIQUID DELIVERY APPARATUS

[76] Inventor: David Mitchell, Church Farm, Winfarthing, Diss, Norfolk IP22ED, United Kingdom

[21] Appl. No.: 977,407

[22] PCT Filed: Sep. 13, 1991

[86] PCT No.: PCT/GB91/01570

§ 371 Date: Mar. 1, 1993

§ 102(e) Date: Mar. 1, 1993

[87] PCT Pub. No.: WO92/04986

PCT Pub. Date: Apr. 2, 1992

[30] Foreign Application Priority Data

Sep. 15, 1990 [GB] United Kingdom ..... 9020220
Apr. 22, 1991 [GB] United Kingdom ..... 9108558

[51] Int. Cl.[5] ..... B05B 9/047

[52] U.S. Cl. ..... 239/67; 239/322; 239/323; 239/468; 239/533.15; 239/553.3; 239/553.5; 222/386.5; 137/624.14

[58] Field of Search ..... 239/67, 68, 148, 322, 239/323, 328, 569, 468, 553, 553.3, 553.5, 533.1, 533.15; 222/386.5, 399, 401; 137/624.14

[56] References Cited

U.S. PATENT DOCUMENTS

| | | | |
|---|---|---|---|
| 2,649,825 | 5/1949 | Hornstein | 239/468 X |
| 2,894,580 | 7/1959 | Becker | 137/624.14 |
| 3,089,651 | 5/1963 | Skerritt | 239/68 |
| 3,698,637 | 10/1972 | McCullough | 239/68 |
| 3,924,809 | 12/1975 | Troup | 239/553.5 X |
| 3,964,685 | 6/1976 | Chauvigne | 239/68 X |
| 4,291,836 | 9/1981 | Chen-Hsiung | 239/68 X |
| 4,824,024 | 4/1989 | Biship et al. | 239/533.15 |
| 5,143,295 | 9/1992 | Okayama et al. | 239/553.5 X |

FOREIGN PATENT DOCUMENTS

| | | | |
|---|---|---|---|
| 0332585 | 9/1989 | European Pat. Off. . | |
| 2911201 | 10/1979 | Fed. Rep. of Germany | 239/67 |
| 1476255 | 4/1967 | France . | |
| 2487789 | 2/1982 | France . | |
| 236725 | 7/1945 | Switzerland | 137/624.14 |
| 2172934 | 10/1986 | United Kingdom . | |

*Primary Examiner*—Karen B. Merritt
*Assistant Examiner*—William Grant
*Attorney, Agent, or Firm*—Larson and Taylor

[57] ABSTRACT

A liquid delivery apparatus including a reservoir into which liquid may be introduced to pressurize the reservoir, an outlet for discharging liquid under the pressure in the reservoir, a valve to control passage of liquid from the reservoir to the outlet, a control mechanism controlling operation of the valve, and a way to transmit the pressure in the reservoir to the valve control mechanism. The valve includes an opening, a closure member for closing the opening, and a biasing spring, the arrangement of which being such that the valve is normally held closed under the force of the biasing spring and the pressure of the liquid in the reservoir. The valve control mechanism includes a movable element which is acted on by the pressure in the reservoir and transmits a resultant force to the closure member in a direction to open the valve, wherein the respective effective surface areas of the movable element and the closure member and the force of the biasing spring are chosen such that the closure member is opened when the pressure of the liquid in the reservoir reaches a predetermined level.

18 Claims, 8 Drawing Sheets

FIG. 9
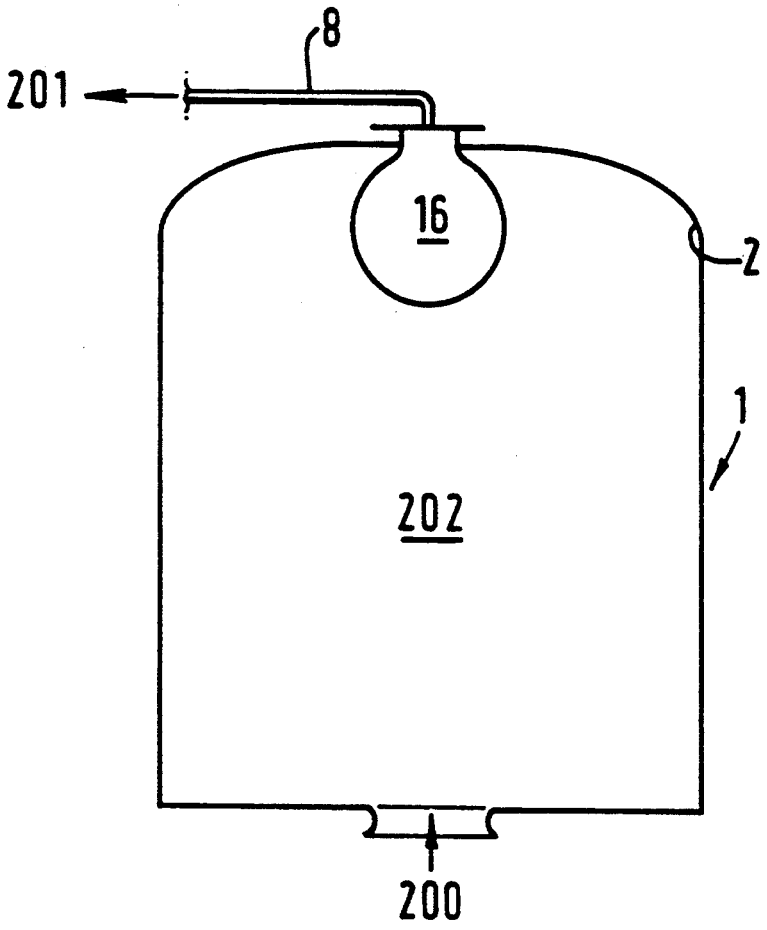
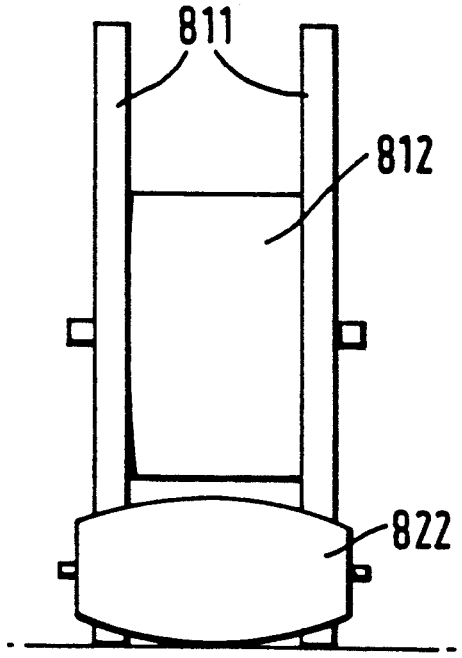
FIG. 13

LIQUID DELIVERY APPARATUS

This invention relates to a liquid apparatus and two new outlet arrangements for such apparatus system.

In order to irrigate farm land with, for instance, a waste liquid such as water run-off, it is presently known to use a pump to pump the liquid through a pipe to a "rain" nozzle. Because of pressure losses over the pipe length, it is necessary to use heavy duty pumps and large bore (75–100 mm) pipes.

Arrangements are known for pressurising a liquid in a vessel, for use, e.g. in domestic or industrial water supply apparatus. One such arrangement comprises a rigid vessel capable of withstanding a high internal pressure and an inner, flexible bag. The liquid to be pressurised is pumped into the bag which expands in the vessel and pressurises the air in the vessel as the volume around the bag decreases. When full operating pressure is reached, the pump is turned off and liquid may be discharged from the vessel under pressure, for instance by a tap.

According to a first aspect of the present invention, there is provided a liquid delivery apparatus comprising:

(i) a liquid reservoir into which a liquid may be introduced via an inlet to pressurise said liquid in the reservoir;

(ii) an outlet via which said liquid may be discharged from the reservoir under the pressure of the liquid in the vessel;

(iii) a valve between the reservoir and the outlet to control passage of liquid from the reservoir to the outlet, said valve having (a) an opening, (b) a closure member adapted to close the opening, and (c) a biasing means, the arrangement of the components of the valve being such that the valve is normally held closed under the force of the biasing means and the pressure of the liquid in the reservoir;

(iv) a valve control mechanism for controlling the operation of the valve in response to the pressure of the liquid in the reservoir; and (v) a means for transmitting the pressure in the reservoir to the valve control mechanism;

wherein the valve control mechanism comprises a movable element which is capable of being acted on by the pressure of the liquid in the reservoir and transmitting a resultant force to the closure member of the valve in a direction to open the valve, and wherein the respective effective surface areas of the movable element and the closure member and the force of the biasing means are chosen such that the closure member is opened when the pressure of the liquid in the reservoir reaches a predetermined level.

The apparatus of the present invention enables a small pump and relatively narrow gauge pipe (e.g. 25–30 mm) to be used in discharging a liquid onto, for example, agricultural land. The pressure of liquid in the reservoir is used to discharge waste liquid over a large area.

In a preferred embodiment, the system may have a rigid housing and an inner movable wall which subdivides the housing into first and second chambers, which are separated by the said wall and which are of variable volume depending upon the position of the said inner movable wall. The wall should be substantially liquid and gas impermeable. The inner wall may be rigid or semi-rigid with provision for moving in the housing to adjust the relative volumes of the first and second chambers. Alternatively, the inner wall may be a flexible membrane. The invention will be described with particular reference to the embodiment in which the inner wall is a flexible membrane. The first chamber on one side of the flexible membrane contains a substantially compressible fluid, normally a gas such as air, whilst the other side is the liquid reservoir into which the liquid to be distributed is pumped. As liquid is pumped into the second chamber (or reservoir), the flexible membrane will move permitting the second chamber to expand whilst reducing the volume of the first chamber and compressing and pressurising the fluid (normally air) in the first chamber. The pressure of the fluid on the one side of the membrane is transmitted (for instance by a simple pipe) to the valve control mechanism for controlling the operation of the valve. The second chamber on the other side of the membrane represents the liquid reservoir from which the liquid for distribution is discharged under pressure. In this embodiment of the present invention, the system may be pre-pressurised by increasing the pressure of the fluid in the first chamber; typically, this will involve compressing the air in the first chamber above atmospheric pressure. An alternative to pre-pressurising the fluid (e.g. air) in the first chamber is to allow air to leak (at a controlled rate) into the second chamber together with the liquid (e.g. water) to be distributed.

The relative volumes of the first and second chambers in the resting state (i.e. with no pressurisation) may vary from device to device. However, in one preferred embodiment, the flexible membrane may be a flexible bag, for example made of a rubber material or the like, which occupies a substantial proportion of the total volume of the rigid housing. In an alternative embodiment, the volume of the first chamber (i.e. on the valve control side of the apparatus) may be small; in such an instance, it has been found to be important to utilise the principle of leaking air into the distribution side of the device (i.e. the second chamber) together with the liquid to be distributed.

The pressure of the liquid in the reservoir may be transmitted to the valve control mechanism either directly or indirectly. Indirect transmission of the pressure may, for example, be via the fluid (e.g. air) in the first chamber formed between the flexible membrane and the rigid housing of the preferred embodiment described above. In this example, the means (v) for transmitting the pressure in the vessel to the control mechanism may comprise a conduit leading from the first chamber to the valve control mechanism.

The movable element of the valve control mechanism may preferably be a wall element of a pressure chamber which chamber is capable of being pressurised by the pressure of the liquid in the vessel. Typically, the pressure of the liquid in the vessel is transmitted to the pressure chamber by the compressed fluid (e.g. air) in the first chamber. The coupling of the movable wall element to the valve element may, for instance, be a direct mechanical or hydraulic linkage. For instance, the wall element may be coupled with the closure member by a force transmission means such as a shaft which transmits the force exerted on the movable wall element to the closure member.

The biasing means is preferably a spring such as a compression spring. The spring may be adjustable in force, for example by the use of wedges which slightly increase the compression of the spring.

The liquid may be introduced into the said reservoir by a pump. The inlet to the reservoir may include a non-return valve to ensure that liquid may only be pumped into the reservoir, and not leak out of the vessel through the inlet. Provision may be made to permit a small, but controlled flow of air into the line supplying liquid to the said reservoir.

The pressure of the liquid in the reservoir may be transmitted directly or indirectly to the pressure chamber. Thus, on the valve control side, the conduit from the first chamber may lead directly into the pressure chamber or there may be a further control arrangement between the first chamber and the valve control mechanism to control the supply of pressure to the valve control mechanism. Normally, the pressure chamber will be filled with a fluid such as air.

This further control mechanism referred to may include a first means for adjusting the pressure of the fluid in the pressure chamber when the pressure of the pressure source is at a first predetermined level in order to move the wall element and transmit a force to the closure member to open the valve, and also a second means for adjusting the pressure of the fluid in the pressure chamber when the pressure of said pressure source is at a second predetermined level in order to permit the wall element to return to its original position and allow the valve to close.

This further control mechanism is particularly suited to controlling the operation of the valve. The movement of the wall element of the pressure chamber is coupled to the closure member of the valve in order to operate (i.e. open or close) the valve.

The further control mechanism may comprise a first pressure sensor capable of sensing when the pressure of the pressure source reaches the first predetermined level and opening a valve in a valve passageway to pressurise the pressure chamber. In this preferred embodiment, the control mechanism also includes a second pressure sensor for determining when the pressure has fallen to the second predetermined level and opening another valve in a valve passageway to discharge the higher pressure in the pressure chamber.

The control mechanism may also include a further valve in a valve passageway linked to the pressure chamber and which is controlled by movement of the moveable wall element. This further valve is arranged to ensure that when pressure is released in the pressure chamber and the movable wall element starts to return to its first position under the force of the biasing means, the pressure in the pressure chamber is allowed to discharge fully. Thus, when the movable wall element moves away from the first position, a linkage between the wall element and the further valve causes the further valve to remain in an open position and ensures that the higher pressure in the pressure chamber is equalised with that in the pressure source. Once pressure in the pressure source starts to build, however, a non-return valve ensures that this higher pressure in the pressure source does not leak into the pressure chamber via the further valve arrangement. Without this arrangement, the pressure chamber might discharge partially and prevent the movable wall element returning fully to its first position under the action of the bias.

The arrangement of the present invention enables the valve to be rapidly opened and closed under control of the pressure in the reservoir. Moreover, the fluid in the pressure source (i.e. the gas or air on the valve control side of the system) does not escape on operation of the valve by the valve control mechanism because the pressure chamber and associated control mechanism (when present) represent a closed system.

The fluid used as the pressure source and associated valve control mechanism and pressure chamber is preferably a gas, most preferably air.

The apparatus of the present invention is particularly suited for discharging a waste liquid, although it would of course be capable of discharging any liquid, such as a clean liquid.

It is also the case that the apparatus of the present invention could be modified such that it operates at pressures below atmospheric pressure. This would create a pulsed suction device. The pressurised device would require modification such that the reservoir could be depressurised, rather than pressurised, and the arrangement would also require changes such that the valve would be opened when a predetermined level of vacuum in the vessel was reached.

A safety mechanism may be provided in the pressure side of the apparatus of the present invention to detect the rise and fall in pressure as the liquid is firs pressurised in the vessel and then discharged. Electrical circuitry can be provided which detects the frequency of the pressure rises and falls and compares this with a preset frequency value. If there is a leak or blockage in the system, the rise and fall in pressure will slow and eventually cease. Once the fall in frequency is detected, it can be arranged that the pump pressurising the liquid in the reservoir is switched off.

The rise and fall (oscillating) of pressure on the pressure side of the apparatus may be coupled to a winch via a bellows motor or other similar device. This enables the apparatus to be driven. For instance, the vessel and associated parts could be mounted on a wheeled frame and a winch (driven for instance by the bellows motor) employed to winch the apparatus along a cable. A rigid or semi-rigid hose connected to the outlet for discharge of the liquid could function also as a cable on which the apparatus is winched. Alternatively, the hose could be hauled in by the winch with the main part of the apparatus fixed and stationary. This arrangement would allow waste water to be distributed over a larger area.

Where the liquid outlet of the apparatus is fixed with respect to the rest of the apparatus the liquid is delivered in a single direction only and the entire apparatus needs to be moved for water to be delivered in other directions. It is therefore advantageous for a liquid delivery apparatus to be able to vary the direction in which it can deliver the fluid.

According to a second aspect of the invention there is provided a liquid delivery apparatus comprising a liquid reservoir into which a liquid may be introduced via an inlet and in which the liquid may be pressurized and an outlet via which the liquid can be discharged from the reservoir under the pressure of the fluid in the reservoir, wherein the outlet is movably mounted with respect to the reservoir and means are provided for causing the outlet to move so that the direction in which the liquid may be discharged relative to the apparatus can be varied.

The outlet may be rotatably mounted on the apparatus.

The means for causing the outlet to move may be mechanically actuated. Preferably, however, the means are actuated by the discharge of liquid from the closed vessel under pressure.

The means for causing the outlet to move may take the form of a striking member mounted on the apparatus so as to be able to strike the outlet causing it to move. The striking member may be biased towards or against the outlet or it may be biased away from the outlet. In the former case the striking member must be forced away from its bias and then allowed to return to strike the outlet and cause it to move. In the latter case the biasing means must be removed to allow the striking member to strike the outlet and cause it to move. The striking member is preferably pivotally mounted with respect to the outlet.

The means for causing the outlet to move could alternatively take the form of the eccentric mounting of the outlet with respect to the direction in which the liquid leaves the closed vessel under pressure. The force of the discharging liquid as it is forced to change direction in travelling from the reservoir to and out of the outlet is thereby used to cause the outlet to move.

The apparatus according to the second aspect of the invention could be combined with the system according to the first aspect of the invention.

According to a third aspect of the present invention, there is provided a liquid delivery apparatus comprising a reservoir into which a liquid may be introduced via an inlet and in which the liquid may be pressurised and an outlet via which the liquid can be discharged from the reservoir under the pressure of the liquid in the reservoir, wherein the outlet comprises a chamber of circular cross-section having an inlet for delivery of fluid from the said reservoir and a plurality of openings from which the liquid for distribution may be discharged under gravity.

Preferably, the said inlet is tangentially disposed with respect to the chamber in order to dissipate energy of incoming liquid and enable it to "dribble" under gravity out of the said openings which may be arranged in one end wall of the chamber.

There may be of the order of 5 to 10 openings in the chamber and each may be connected to a pipe for distribution of the fluid under gravity.

This particular arrangement enables fluid to be discharged other than through a high pressure nozzle (which is associated with air-pollution) and also has the advantage that relatively large openings may be employed, which do not block easily. The apparatus according to the third aspect of the invention could combined with the apparatus of the first and/or second aspects of this invention.

For a better understanding of the present invention, and to show how the same may be carried into effect, reference will now be made, by way of example, to the accompanying drawings in which:

FIG. 9 is an alternative arrangement of the water reservoir shown in FIG. 1;

FIG. 13 shows a simplified front profile of the equipment shown in FIG. 12 omitting the water-distribution and drive components.

Figure 1:
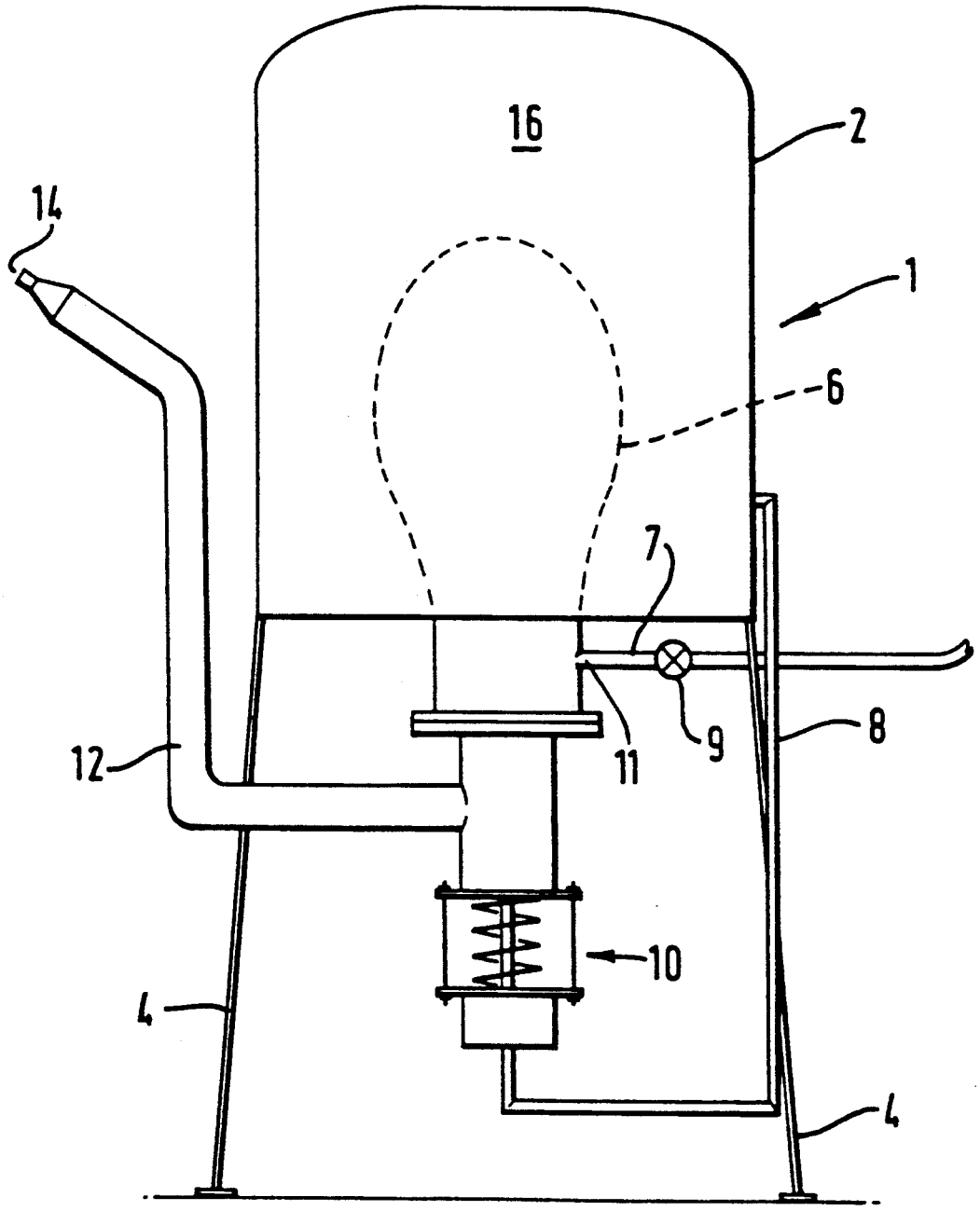
FIG. 1 shows a water distributing apparatus in accordance with the first aspect of the present invention.

The water distributing apparatus 1 shown in FIG. 1 comprises a rigid outer wall 2 capable of containing and withstanding a high internal air pressure, ground engaging legs 4, a flexible membrane or bag 6 and an air control line 8, a valve control arrangement 10, a junction chamber 11 and a water discharge line 12 (which may be of any desired length) terminating in a "rain" nozzle 14. Defined between the flexible bag 6 and the rigid outer wall 2 is an air space 16. An inlet 11 to the flexible bag 6 is provided, the inlet 11 communicating with an inlet pipe 7 in which a one-way valve 9 is fitted.

Figure 2:
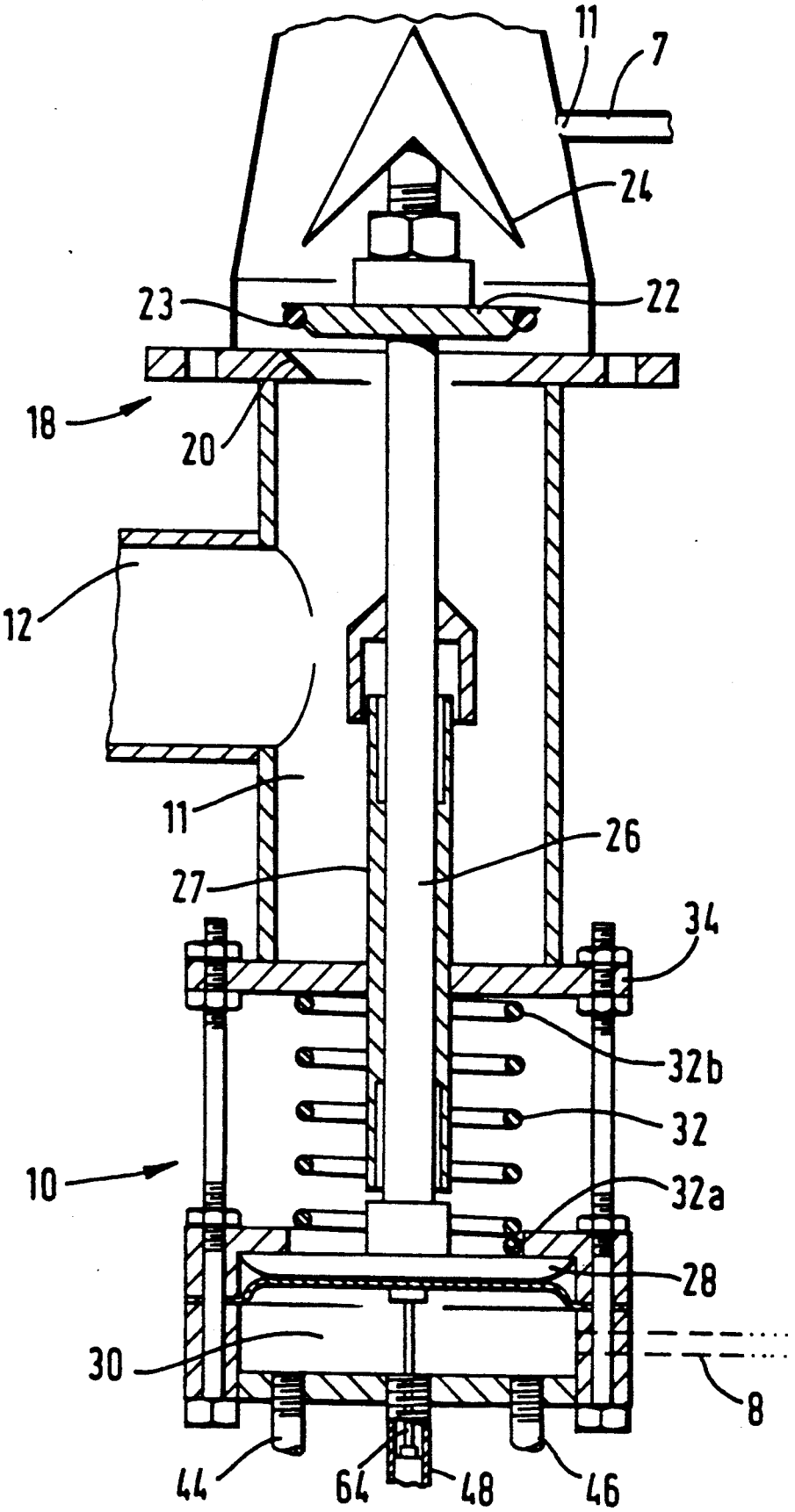
FIG. 2 shows the valve control arrangement of the water distributing apparatus shown in FIG. 1.

In FIG. 2, there is shown a valve arrangement 18 comprising a valve seat 20 and a valve closure 22 having a sealing ring 23. Associated with the primary value arrangement 18 is a deflector 24. The control arrangement 10 comprises a shaft 26 in a sleeve 27 which links the closure member 22 to a movable element 28 which defines a wall of a pressure chamber 30. A compression spring 32 has a first end 32A which bears on the movable wall element 28 exerting a force on the movable wall element 28 downwards in FIG. 2 tending to reduce the volume of chamber 30. This force also tends to close the valve via shaft 26. The compression spring 32 has another, second, end 32B which bears against the lower wall 34 of the junction chamber 11 in the flow line of waste water from the flexible bag 6 to the discharge pipe 12. This junction chamber 11 is sealed with respect to the control arrangement 10.

Figure 3:
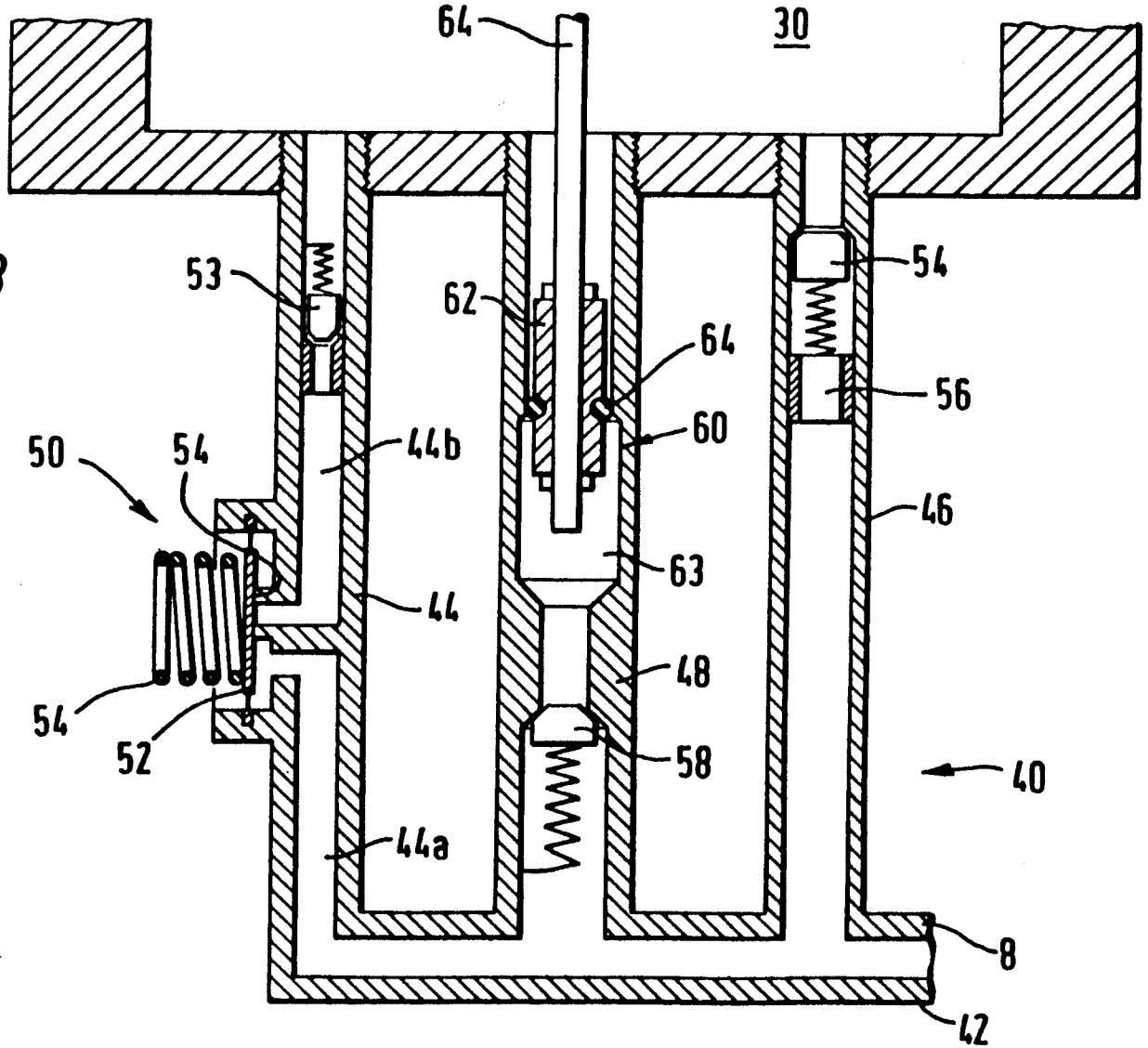
FIG. 3 shows, in more detail, the control mechanism of the valve control arrangement shown in FIG. 2.

The control arrangement 10 may comprise a control mechanism 40 which is shown in FIG. 3, although this is not essential. This control mechanism 40 controls movement of the movable element 28 in response to the pressure of air in the space 16 (FIG. 1). This air pressure is communicated to the control mechanism by pipe line 8 (also see FIG. 1). The control mechanism 40 comprises an air input 42 communicating with pipe 8 and the mechanism has three branch lines 44, 46 and 48 each of which is in controlled communication with the pressure chamber 30.

First branch line 44 comprises a first portion 44*a* and a second portion 44*b*. These two portions are separated by a pressure valve 50 comprising a diaphragm 52 and a spring 54 urging the diaphragm 52 into abutment with a valve seat 54. In the portion 44*b* of the branch line 44 there is provided a first non-return valve 53.

Second branch line 46 includes an adjustable second non-return valve 54 having an adjustment means 56.

Third branch line 48 includes a third non-return valve 58 and a spool valve arrangement 60. Spool valve arrangement 60 comprises an enlarged passage 63 and a spool valve element 62 having a sealing ring 64. The spool valve 60 also includes a stem 64 which links the spool valve element 62 with the movable wall element 28 (see FIG. 2).

Figure 4:
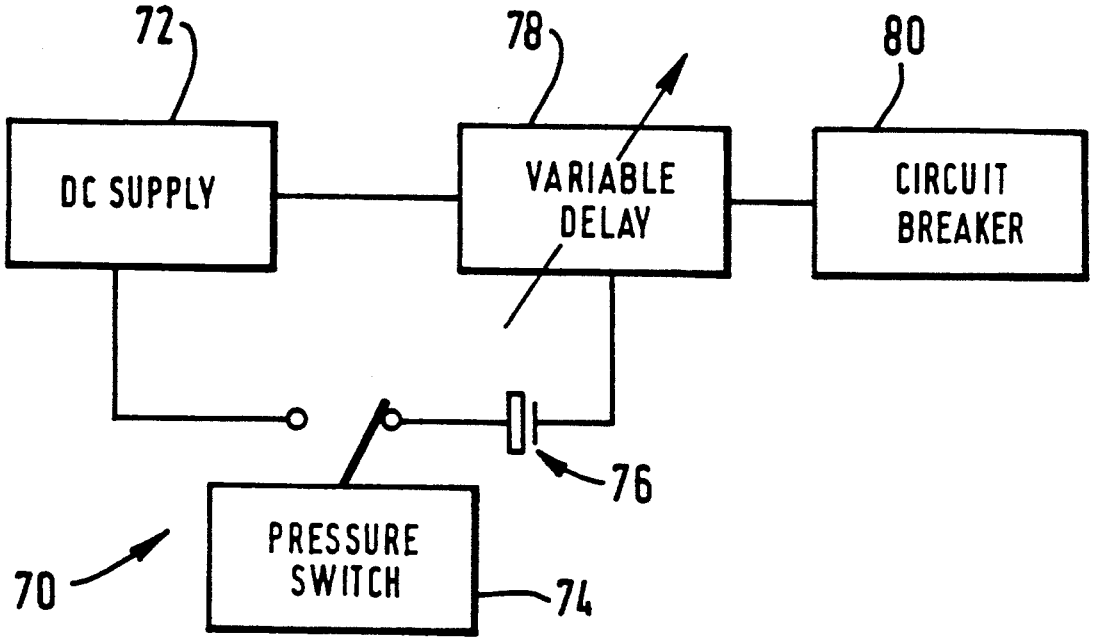
FIG. 4 is a schematic view of a safety monitoring circuit useful in controlling the water distributing apparatus of the present invention.

FIG. 4 shows safety circuitry 70 comprising a DC supply 72, a pressure switch 74, a capacitor 76, a variable delay 78 and a motor circuit breaker 80.

Figure 5:
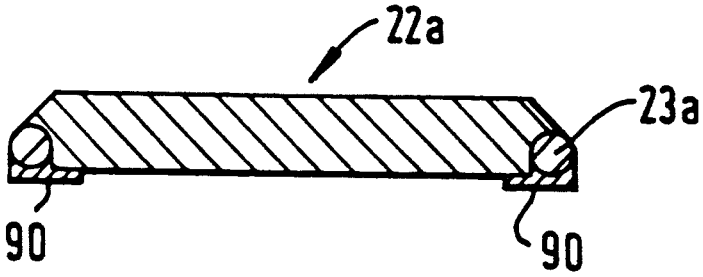
FIG. 5 illustrates a modified valve closure member.

The modified valve closure member 22a shown in FIG. 5 may replace the valve control member 22 shown in FIG. 2. This modified closure member has an alternative method of holding a sealing O-ring 23a comprising a removable ring 90 which secures the O-ring 23a in position.

Figure 6:
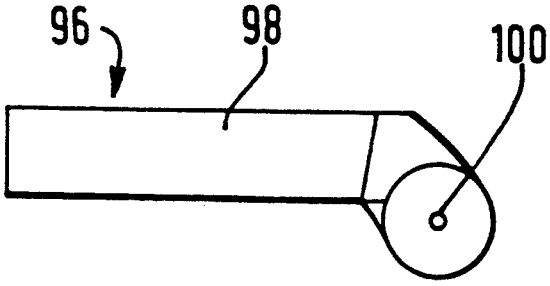
FIG. 6 illustrates a first embodiment of a rotatable raingun according to the second aspect of the invention.

FIG. 6 illustrates a raingun 96 which may be used to replace the nozzle 14 at the end of pipe line 12 shown in FIG. 1. The raingun 96 comprises a barrel 98 which is offset from a pivot 100. As waste water is discharged through the barrel 98, the raingun 96 is made to rotate by recoil action; waste liquid is therefore distributed over a wider area.

Figure 7:
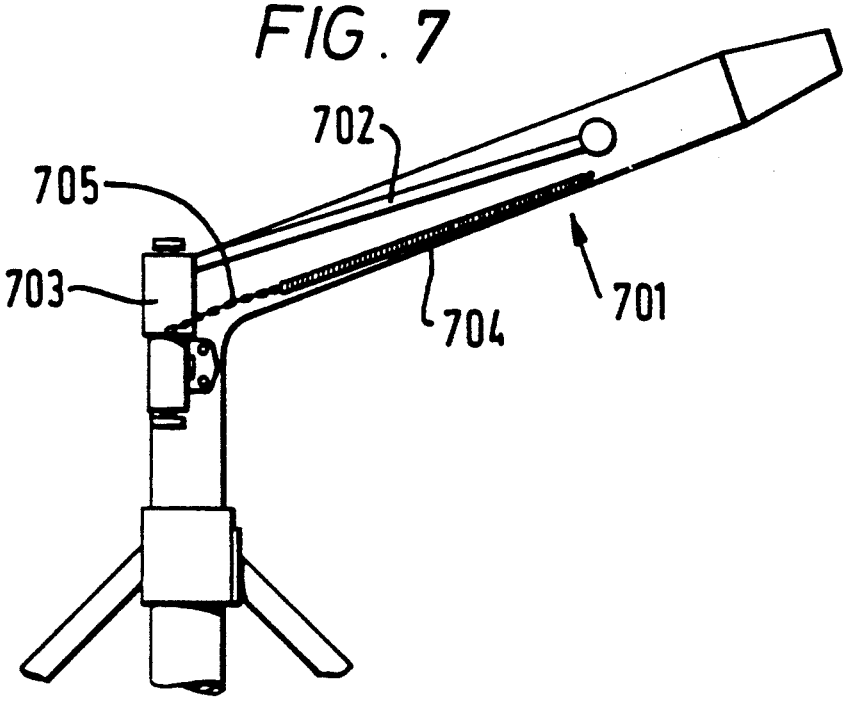
FIG. 7 is an elevational view of a second embodiment of a rotatable raingun in a first position.
Figure 8:
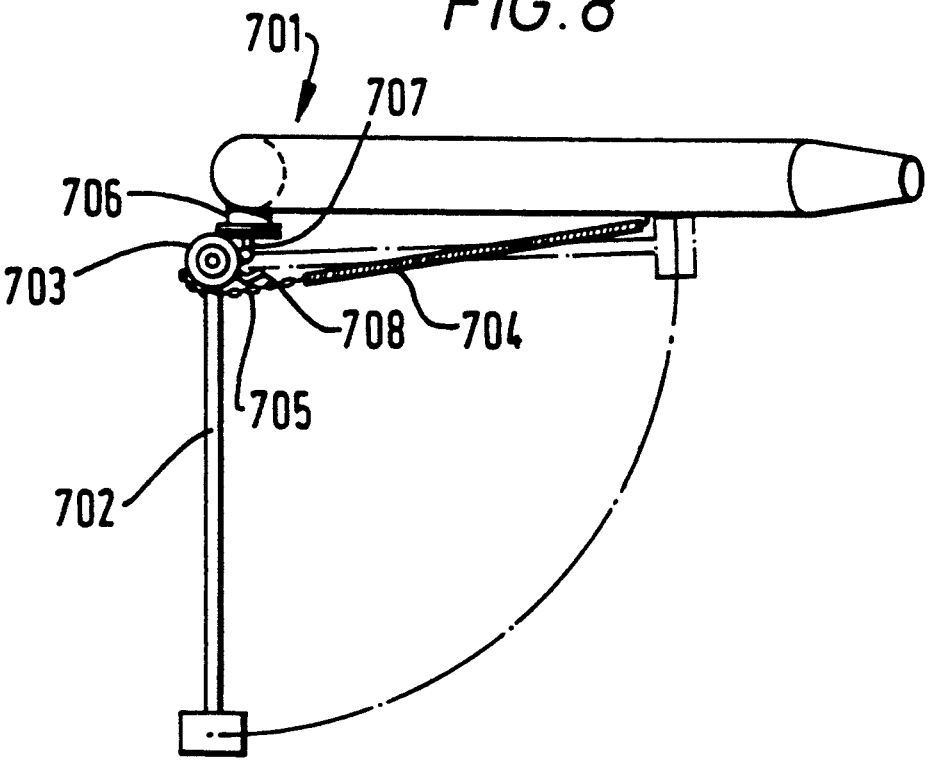
FIG. 8 is a plan view of the embodiment of FIG. 7 in a second position.

In FIGS. 7 and 8 there is shown a rotatable raingun in accordance with the second aspect of the invention. The outlet 701 is in the form of a cranked pipe which is rotatably mounted to the rest of the apparatus. A hammer 702 which acts as the striking member is pivotally mounted via support 703 and biased to lie against the outlet 701 by means of spring 704 attached to support 703 by means of chain 705. A piston 706 is so mounted in the outlet pipe 701 that when fluid is discharged under pressure from the closed vessel (not shown in FIGS. 7 and 8) the piston is forced outwards causing its piston rod 707 to push against a projection 708 on support 703. In this way support 703 is caused to rotate and hammer 702 is swung out in a circle, in practice to a position about 270° from its starting position. When the hydraulic pressure on piston 706 is reduced the tension in spring 704 causes the hammer 702 to return to its starting position with force where it strikes against the outlet pipe 701 causing it to rotate with respect to the closed vessel such that the fluid is next discharged in a direction differing from that in which it was last discharged.

The mode of operation of the water distributing apparatus of the first aspect of the present invention is best shown by reference to an embodiment of the invention which is somewhat more simple than that shown in the drawings, i.e. one in which air supply line 8 leads directly to the pressure chamber 30 as shown by broken lines in FIG. 2. Thus, such an embodiment does not include the control mechanism 40. Operation is as follows. At the outset, and before the introduction of any water through the inlet into the chamber surrounding the deflector 24, the only force at work is the compression spring 32 which urges the wall element or diaphragm 28 downwards into its lower position and, via the action of the shaft 26, causes the valve member 22 to adopt its lower, closed position.

As water is introduced under pressure into the chamber surrounding the deflector 24 the pressure builds up and the increased pressure acts on the upper surface of the valve 22 tending to keep that valve closed. The same pressure is transmitted via the flexible bag 6 to the air surrounding the bag 6 and hence through the pipe 8 to the chamber 30. As the cross-sectional area of the diaphragm plate 28 exceeds that of the valve member 22 there is a greater hydrostatic/pneumatic force acting upwards on the underside of the diaphragm 28 than there is acting downwards on the upper side of the valve member 22; however, the valve member 22 remains in the lower, closed position until such time as the difference in force on the diaphragm 28 and the valve member 22 exceeds the downward force caused by the spring 32 on the upper face of the diaphragm 28.

When this happens the diaphragm 28, shaft 26 and valve member 22 move upwards so as to open the upper valve, thereby permitting the considerable volume of water under great pressure within the flexible bag to shoot past the deflector 24 to the valve and (as the valve member 22 is in the raised position as shown in FIG. 2) enter the junction chamber 11 and out through the water discharge line 12.

It will be seen, therefore, that the surface areas of the closure member 22 and the movable wall element 28 and the force of the spring are critical and must be chosen to give the correct pressure at which it is desired for the valve 18 to open. In the present example, the diameter of the valve 22 is about 100 mm, the diameter of the wall element 28 is about 125 mm, and the force of the spring is about 150 kg. This gives an opening pressure of about 7 bar and a closing pressure of about 3 bar. Once the valve 18 opens, the fluid pressure on the closure member 22 is released and the valve 18 will stay open until the pressure in the pressure chamber 30 has dropped sufficiently that the force of the spring 32 will close the valve 18.

Returning to the more sophisticated embodiment including the control mechanism 40 shown in FIG. 3, the mode of operation is as follows. Initially, (i.e. before priming), the pressure of the air in the pressure chamber 30 is at a low level and the chamber 30 is sealed from the air in the air space 16 by the non-return valves 53, 54 and 58 and the pressure sensor mechanism 50 shown in FIG. 3. The movable wall element 28 in FIG. 2 is effectively urged by the spring means 32 in a direction which tends to reduce the volume of the chamber 30 in view of the low pressure in the chamber 30 and the primary valve 18 is closed. The spool valve arrangement 60 is open with the valve element 62 being displaced upward as shown in FIG. 3. When the pressure in the air space 16 reaches a first predetermined level which may be, for example, of the order of 7 bar, this is usually sufficient to enable the waste liquid to be sprayed a substantial distance out of the nozzle 14 in FIG. 1. The pressure sensor arrangement 50 is set to open at this pressure; thus, when the pressure reaches the first predetermined level the air pressure on the diaphragm 52 overcomes the force of the spring 54 thereby enabling portions 44a and 44b of the first branch 44 to be brought into communication. The pressure of air in the control mechanism 40 is then sufficient to overcome the closing force of the one way valve 53 and pressurise the chamber 30. Essentially, the pressure chamber 30 is pressurised to the same pressure as the pressure of the air space 16. Movable wall element 28 is, as a result, moved against the force of the biasing means 32 and this, in turn, moves stem 26 thereby to open the primary valve arrangement 18 (FIG. 2). The spool valve arrangement 60 in FIG. 3 is closed by adopting the position shown in FIG. 3 with the sealing ring 64 sealing the narrow passageway in which the spool element 62 moves. The pressure chamber 30 is now sealed with respect to the control mechanism 40 and the movable wall element 28 is therefore maintained in the position shown in FIG. 2.

As the waste water is dispelled via the discharge tube 12 to the nozzle 14, the pressure of the air in the air space 16 decreases and, therefore, the air pressure in the control mechanism 40 decreases. At a pre-set low level, for instance about 3 bar, the adjustable non-return valve arrangement 54 in branch line 46 is set to open in order to permit the higher pressure in the pressure chamber 30 to discharge. As the pressure in the pressure chamber 30 discharges, the movable wall element 28 moves under the action of the spring 32 to reduce the volume of the chamber 30. This, via stem 64, causes the spool valve arrangement 60 to open thereby enabling the pressure in the pressure chamber 30 to be fully discharged through the non-return valve 58. This ensures that the pressure in the pressure chamber 30 and the control mechanism 40 are quickly equalised. Without the spool valve arrangement 60, it is possible that the pressure in the pressure chamber 30 will only be allowed to discharge partially to the non-return valve 54.

The system is now ready for another cycle.

The circuitry in FIG. 4 may be used to detect leaks or blockages in the system. This can be done by monitoring the pressure in the system in order to check that the pressure correctly rises and falls as it operates. The pressure switch 74 can be operated by the water pressure at the pump or the pressure in the air supply side of the control mechanism 10. The DC voltage of the DC supply 72 is modified to intermittent DC by the operation of the pressure switch 74. This intermittent DC can be passed through an electrical capacitor 76 to a sensing circuit which operates the delay 78. If the sensing circuit does not receive a signal from the combination of the pressure switch 74 and capacitor 76 according to a pre-set time, it switches of the water pump which pumps waste water into the flexible bag 6 in the vessel 2 as described.

FIG. 9 shows an alternative arrangement for the vessel to that shown in FIG. 1. Liquid for distribution enters the reservoir 202 in the direction shown by arrow 200. This liquid may also have a small amount of air in it which is introduced via a controlled leak to improve efficiency and as a result, the flexible bag 6 can be reduced in size considerably so that the air space 16 is relatively small; the pressure of the air in the airspace 16 controls the valve control mechanism (not shown) in the direction indicated by arrow 201.

Figure 10:
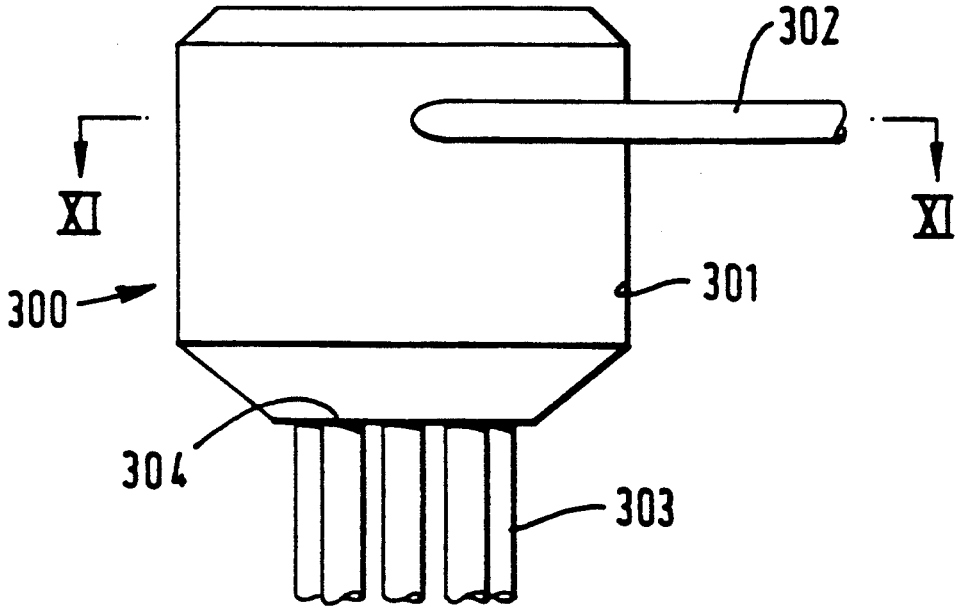
FIGS. 10 and 11 illustrate an alternative distribution outlet.
Figure 11:
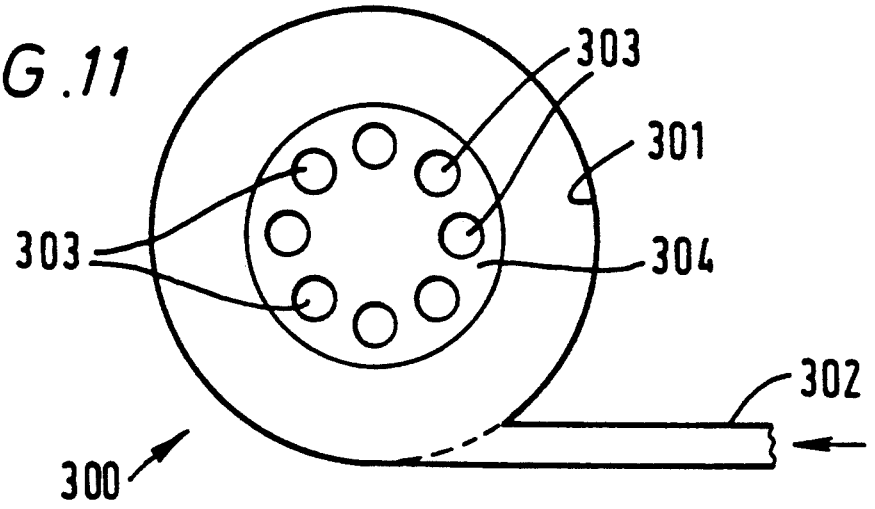

FIGS. 10 and 11 illustrate an alternative form of outlet arrangement 300 comprising a circular chamber 301 having a tangential inlet 302 and a plurality of openings 303 in the base 304 of the chamber. Liquid under pressure is introduced into the chamber 301 via inlet 302 where it forms a vortex. Liquid then discharges under gravity through the relatively large (e.g. ½ to 1 inch in diameter) openings 303 which may each be connected to hoses (not shown) for further distribution as required.

Figure 12:
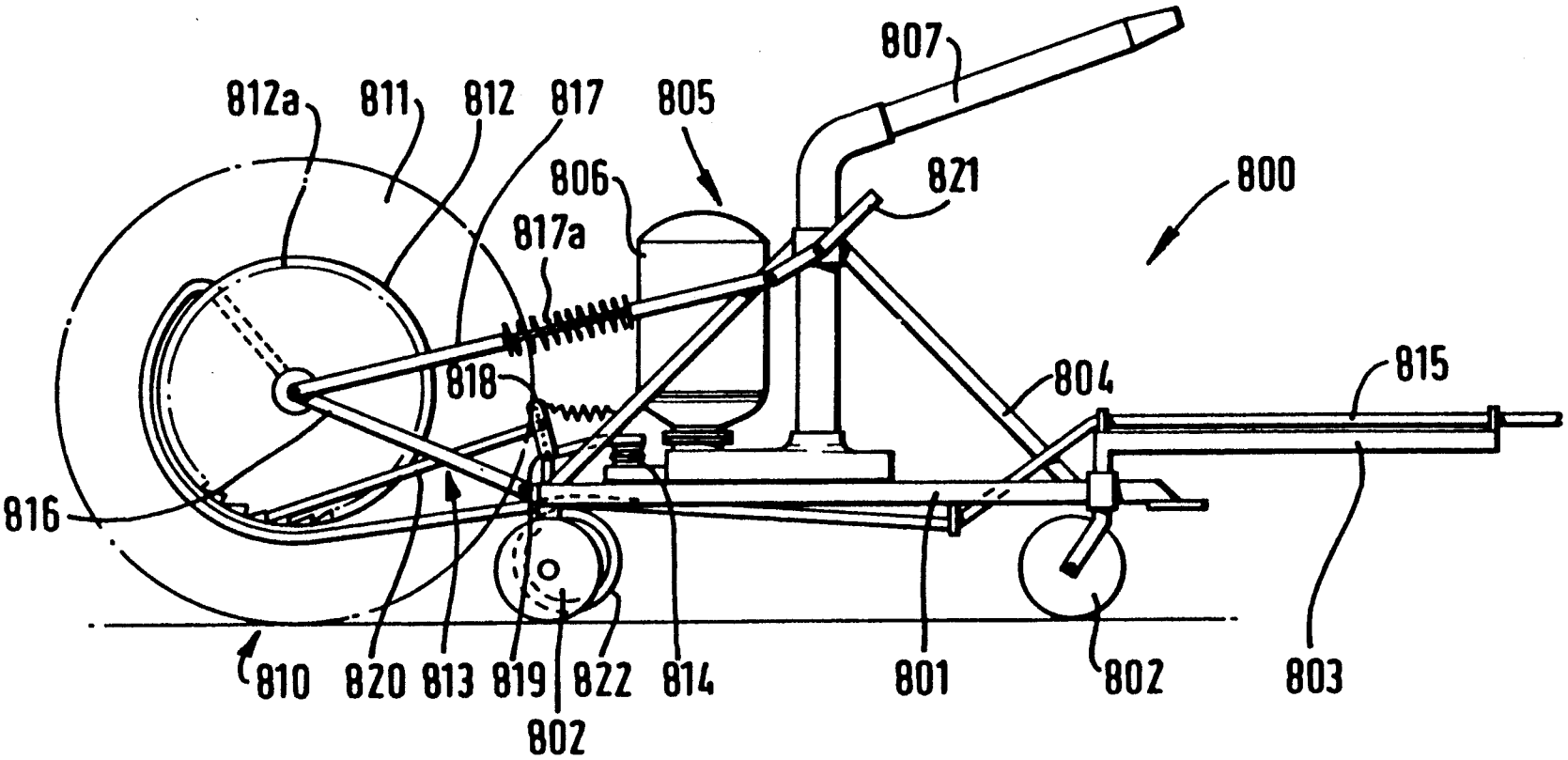
FIG. 12 shows in elevation a self-propelled form of water-distribution equipment in accordance with the invention.

FIGS. 12 and 13 illustrate a self-propelled form of the water-distribution apparatus shown generally in FIG. 1. The equipment 800 comprises a chassis 801 having wheels 802 (two only shown), a steering arm 803 and a framework 804 which supports the water-distribution apparatus 805. The water-distribution apparatus 805 comprises a rigid outer housing 806 which is connected to a raingun 807 (as described more fully above). At the rear of the equipment 800 there is mounted a spool arrangement 810 which comprises two ground-engaging wheels 811 connected by a central spool member 812. The outer periphery of the central spool member 812 is provided with a ratchet arrangement **812*a* which interconnects, via a ratchet linkage 813, with a bellows motor 814. The bellows motor 814 is driven by the rise and fall (or the variation) in the water-distribution housing 806. A pipeline 815 delivering water for distribution is carried on the arm 803 and the chassis 801 to the rear of the equipment and the spool arrangement 810. The end of the pipeline 815 communicates with the water-distribution equipment via a line which is not shown but which links the centre of the spool member 812 with the water distribution equipment 805**.

The spool arrangement 810 is connected via connecting arms 816 and 817 to the chassis 801 and the frame work 804. Connecting arm 817 includes an adjustable spring **817*a***.

The ratchet linkage 813 enables reciprocating movement in the bellows motor 814 to be transformed into linear motion of the equipment 800 along the ground. Thus, the linkage 813 comprises a lever 818 which is connected to the bellows motor 814 about a pivot point 819. A rod 820 is connected at one end to the lever 818 (which has an adjustable position) and at the other end engages the ratchet **812*a*** on the spool member.

The spool arrangement 810 may be lifted from the ground by operation of a pivotable lever 821 which is connected to the spool arrangement 810 by the connecting arm 817. Lever 821 includes an over-centre mechanism in order to ensure that the spool arrangement 810 may be lifted from the ground on operation of the lever 821.

In the working mode, the equipment 800 is moved forward by two means. Firstly, by tension at pipeline 815 and secondly by the contact of the spool arrangement 810 with the ground, since the outside of the wheels 811 of the spool arrangement 810 will be rotating faster than the speed at which the pipe 815 is wound The adjustable spring **817*a* allows for any necessary slippage. Thus, in use, the bellows motor 813 reciprocates and the movement is transmitted via the lever 818, the rod 820 to drive the ratchet on the spool member 812. In order to ensure that the pipe is wound evenly onto the spool 812, a roller 822 is provided which is curved such that it is of a larger diameter on the inside than at its two ends (see FIG. 13) and this biases the pipe 815 to the outside of the spool 822**.

For transporting equipment 800, the lever 821 is operated putting tension on the connecting arm 817 and, via an over-centre mechanism, raising the spool mechanism 810 clear of the ground.

The forward wheel 802 of the equipment 800 is a castor wheel and is steered by the steering arm 803 which is guided by the pipeline 815 which is held to the arm 803.

Employing the equipment of the present invention enables the water distribution apparatus to be drawn along the ground by the pipe which is delivering liquid for distribution to the apparatus. This enables the water to be spread over a much larger area than would be possible without such a drive arrangement or mechanism.

I claim:

1. A liquid delivery apparatus comprising (i) a liquid reservoir into which a liquid may be introduced via an inlet to pressurize liquid in the reservoir;

(ii) an outlet via which said liquid may be discharged from the reservoir under the pressure of the liquid in the reservoir;

(iii) a valve between the reservoir and the outlet to control passage of liquid from the reservoir to the outlet, said valve having (a) an opening, (b) a closure member adapted to close the opening, and (c) a biasing means, the arrangement of the components of the valve being such that the valve is normally held closed under the force of the biasing means and the pressure of the liquid in the reservoir;

(iv) a valve control mechanism for controlling the operation of the valve in response to the pressure of the liquid in the reservoir; and (v) a means for transmitting the pressure in the reservoir to the valve control mechanism;

wherein the valve control mechanism comprises a movable element which is capable of being acted on by the pressure of the liquid in the reservoir and transmitting a resultant force to the closure member of the valve in a direction to open the valve, and wherein the respective effective surface areas of the movable element and the closure member and the force of the biasing means are chosen such that the closure member is opened when the pressure of the liquid in the reservoir reaches a predetermined level.

2. A liquid delivery apparatus according to claim 1, including a rigid housing and an inner movable wall which sub-divides the housing into first and second chambers which are of variable volume depending upon the position of the said inner movable wall in the housing, the first chamber containing a substantially compressible fluid and the second chamber defining said liquid reservoir.

3. A liquid delivery apparatus according to claim 2, wherein the inner movable wall is at least semi-rigid, with provision to move in the housing to adjust the relative volumes of the first and second chambers.

4. A liquid delivery apparatus according to claim 2, wherein the inner movable wall comprises a flexible membrane.

5. A liquid delivery apparatus according to claim 4, wherein the flexible membrane is a flexible bag.

6. A liquid delivery apparatus according to claim 2 wherein there is provided means for transmitting the pressure of fluid in the first chamber to the valve control mechanism for controlling the operation of the valve.

7. A liquid delivery apparatus according to claim 2 wherein the movable element of the valve control mechanism is a wall element of a pressure chamber which chamber is capable of being pressurized by the pressure of the liquid in the reservoir.

8. A liquid delivery apparatus according to claim 7, further comprising a control arrangement between the first chamber and the valve control mechanism to control the supply of pressure to the valve control mechanism.

9. A liquid delivery apparatus according to claim 8, wherein the control arrangement includes a first means for adjusting the pressure of the fluid in the pressure chamber when the pressure in the first chamber is at a first predetermined level in order to move the wall element and transmit a force to the closure member to open the valve, and a second means for adjusting the pressure of the fluid in the pressure chamber when the pressure in the first chamber is at a second predetermined level in order to permit the wall element to return to its original position and allow the valve to close.

10. A liquid delivery apparatus according to claim 1 further including a movable frame and including means for driving the frame in response to the oscillating pressure of liquid in the liquid reservoir.

11. A liquid delivery apparatus as claimed in claim 10, wherein the oscillating pressure in the liquid reservoir drives a bellows motor which, in turn, is coupled to a winch for moving the frame on which the delivery apparatus is accommodated.

12. A liquid delivery apparatus according to claim 1, wherein said outlet is movably mounted with respect to the reservoir and means are provided for causing the outlet to move, such that the direction in which liquid discharged relative to the apparatus variable.

13. A liquid delivery apparatus according to claim 12, wherein the said outlet is rotatably mounted on the apparatus.

14. A liquid delivery apparatus according to claim 12, wherein the means for causing the outlet to move is mechanically actuated.

15. A liquid delivery apparatus according to claim 12, wherein the means for causing the outlet to move is actuated by the discharge of liquid from the reservoir under pressure.

16. A liquid delivery apparatus according to claim 12, wherein the means for causing the outlet to move is a striking member mounted on the apparatus so as to be able to strike the outlet causing it to move.

17. A liquid delivery apparatus according to claim 1, wherein the outlet comprises a chamber of circular cross-section having an inlet for delivery of liquid from said reservoir and a plurality of openings from which the liquid for distribution is dischargeable under gravity.

18. A liquid delivery apparatus according to claim 17, wherein said chamber inlet is tangentially disposed with respect to the chamber in order to dissipate energy of incoming liquid.

* * * * *